US010308406B2

(12) United States Patent
Koike

(10) Patent No.: US 10,308,406 B2
(45) Date of Patent: Jun. 4, 2019

(54) FASTENER

(71) Applicant: PIOLAX, INC., Yokohama-shi (JP)

(72) Inventor: Takashi Koike, Yokohama (JP)

(73) Assignee: PIOLAX, INC., Yokohama-Shi, Kanagawa (JP)

( * ) Notice: Subject to any disclaimer, the term of this patent is extended or adjusted under 35 U.S.C. 154(b) by 0 days.

(21) Appl. No.: 15/789,726

(22) Filed: Oct. 20, 2017

(65) Prior Publication Data

US 2018/0111729 A1 Apr. 26, 2018

(30) Foreign Application Priority Data

Oct. 24, 2016 (JP) ..... 2016-208137

(51) Int. Cl.
*F16B 2/08* (2006.01)
*B65D 63/10* (2006.01)

(52) U.S. Cl.
CPC ..... *B65D 63/1027* (2013.01); *B65D 63/1072* (2013.01); *B65D 2563/108* (2013.01)

(58) Field of Classification Search
CPC ..... F16B 2/08; B65D 63/1027; B65D 3/1072; B65D 2563/108
See application file for complete search history.

(56) References Cited

U.S. PATENT DOCUMENTS 5,601,261 A * 2/1997 Koike ..... B60R 16/0215 24/16 PB
5,803,413 A * 9/1998 Benoit ..... B65D 63/1072 24/16 PB
6,718,597 B2 * 4/2004 Geiger ..... B65D 63/1072 24/16 PB
7,066,701 B2 * 6/2006 Kovac ..... F16B 37/0842 411/433
7,437,804 B1 * 10/2008 Geiger ..... B65D 63/1072 24/16 PB
9,828,151 B2 * 11/2017 Aoyama ..... F16B 21/086
2008/0008560 A1 * 1/2008 Wakabayashi ..... B60R 16/0215 411/510
2016/0223100 A1 * 8/2016 Geiger ..... F16L 3/137
2016/0355310 A1 * 12/2016 Rogers ..... B65D 63/1072
2018/0058609 A1 * 3/2018 Van Hulst ..... F16B 2/08
2018/0111645 A1 * 4/2018 Arima ..... B62D 25/145

FOREIGN PATENT DOCUMENTS

JP 2000-179523 A 6/2000

* cited by examiner

*Primary Examiner* — Bradley Duckworth
(74) *Attorney, Agent, or Firm* — McGinn I.P. Law Group, PLLC.

(57) ABSTRACT

There is provided a fastener including a band, a band fastening portion and a mounting portion. The band fastening portion includes a passage hole, a locking claw, a supporting wall portion, and a pair of side wall portions. The supporting wall portion extends in a direction from an inlet opening towards an outlet opening and has end faces. The band has a proximal end portion extending from the end face of the supporting wall portion. The pair of side wall portions are disposed so as to define a gap in a widthwise direction between the proximal end portion and themselves. End faces of the pair of side wall portions project further in a passing direction of the band through the passage hole than the end face of the supporting wall portion.

20 Claims, 6 Drawing Sheets

FASTENER

CROSS-REFERENCE TO RELATED APPLICATIONS

The disclosure of Japanese Patent Application No. 2016-208137 filed on Oct. 24, 2016, including specification, drawings and claims is incorporated herein by reference in its entirety.

TECHNICAL FIELD

The present invention relates to a fastener for mounting a member to be mounted on a mount member.

BACKGROUND

A bolt clamp disclosed in Patent Document 1 is formed integrally with a tying band for a wiring harness. This bolt clamp has a cylindrical main body into which a bolt is inserted, a fastening portion of the tying band which is formed on a side surface of the cylindrical main body and the tying band which extends from a side surface of the fastening portion.

In the bolt clamp of Patent Document 1, a wiring harness is tied with the tying band, and a bolt which projects from a vehicle body is inserted into the cylindrical main body, whereby the wiring harness is fixed to the vehicle body. A lower end face of the fastening portion is positioned above a lower end face of the cylindrical main body, and this ensures a space into which a cut end of the tying band is allowed to project when the wiring harness is mounted on the vehicle body, so that the cut end of the tying band is prevented from being brought into abutment or contact with the vehicle body.

Patent Document 1: JP-A-2000-179523

The tying band disclosed in Patent Document 1 extends from the side surface of the fastening portion and extends from a position which lies greatly apart in an axial direction from the lower end face of the cylindrical main body, and therefore, the wiring harness is tied in a position which lies farther away from the vehicle body. In case the wiring harness is held in the position which lies greatly apart from the vehicle body when the wiring harness is mounted on the vehicle body, the stability of the mounted wiring harness is reduced.

SUMMARY

It is therefore an object of at least one of the embodiments of the present invention to provide a fastener which makes it difficult for a proximal end side of a band to be cut when cutting a distal end side of the band while holding a member to be mounted in a stable fashion.

According to an aspect of the embodiments of the present invention, there is provided a fastener for mounting a member to be mounted on a mount member which includes a band for fastening a member to be mounted, a band fastening portion for locking the band which is tightened to fasten the member to be mounted, and a mounting portion for mounting the band fastening portion on a mount member. The band fastening portion has a passage hole having an inlet opening and an outlet opening for the band, a locking claw which locks on the band which is passed through the passage hole, a supporting wall portion which surrounds the member to be mounted together with the band which is passed through the passage hole and a pair of side wall portions which are positioned individually on both sides of the passage hole while connecting to both sides of the supporting wall portion. The supporting wall portion extends in a direction from the inlet opening towards the outlet opening and has end faces which lie individually on a side thereof which faces the inlet opening and a side thereof which faces the outlet opening. The band has a proximal end portion which extends from the end face of the supporting wall portion which lies on the side thereof which faces the outlet opening. The pair of side wall portions are disposed so as to define a gap in a widthwise direction between the proximal end portion of the band and themselves, and end faces of the pair of side wall portions which lie on sides thereof which face the outlet opening project further in a passing direction of the band through the passage hole than the end face of the supporting wall portion which lies on the side thereof which faces the outlet opening.

With the above configuration, it is possible to provide the fastener which makes it difficult for the proximal end side of the band to be cut when cutting the distal end side of the band while suppressing a rattling looseness of the member to be mounted when the fastener holds the member to be mounted.

DETAILED DESCRIPTION OF THE EMBODIMENTS

Figures 1A, 1B, 1C:
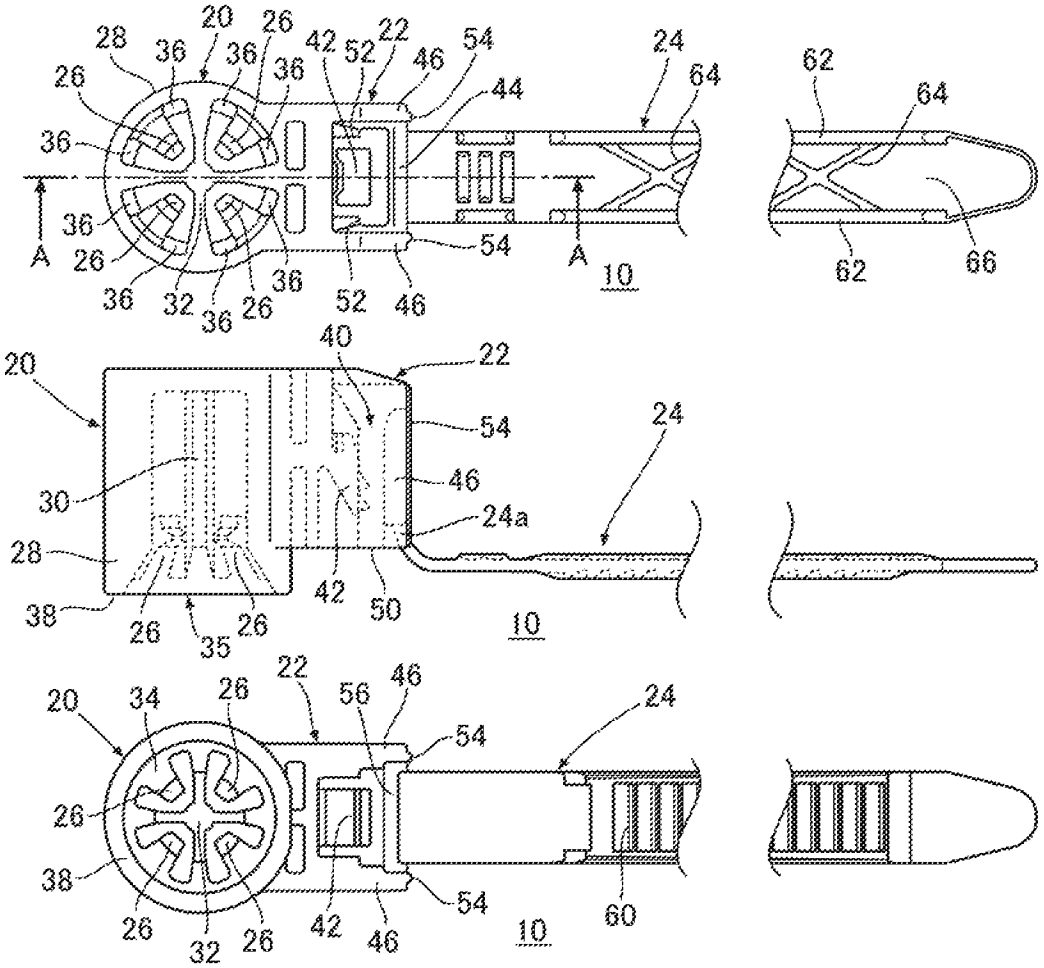
FIG. 1A is a top view of a fastener according to an embodiment of the invention.
FIG. 1B is a side view of the fastener.
FIG. 1C is a bottom view of the fastener.
Figure 2A:
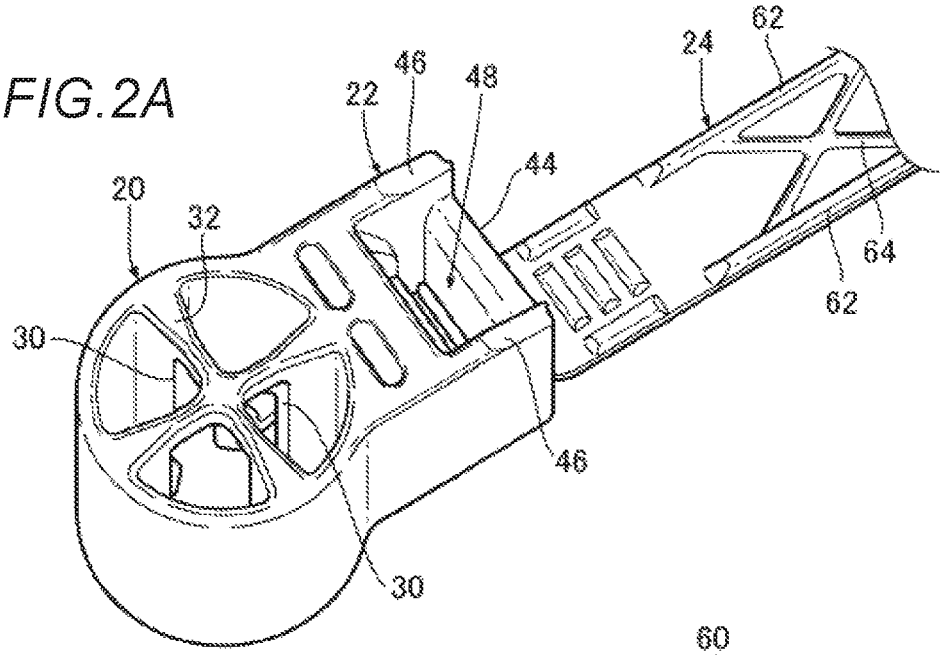
FIG. 2A is a perspective view of the fastener of the embodiment as seen from above.
Figure 2B:
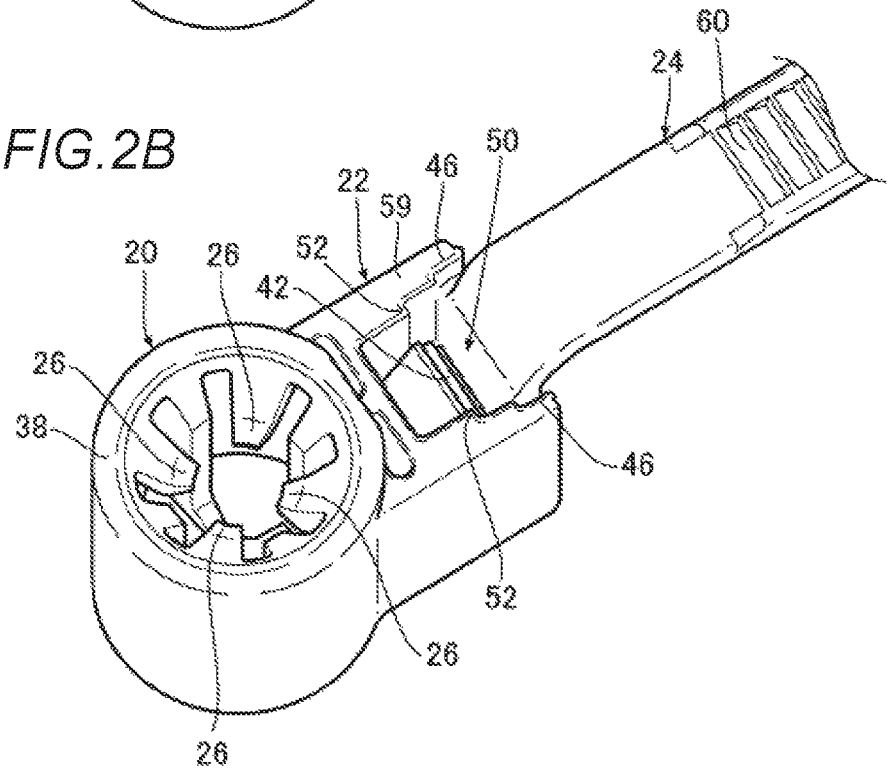
FIG. 2B is a perspective view of the fastener as seen from below.

FIG. 1A is a top view of a fastener 10 according to an embodiment of the invention, FIG. 1B is a side view of the fastener 10, and FIG. 1C is a bottom view of the fastener 10. FIG. 2A is a perspective view of the fastener 10 of the embodiment as seen from above, and FIG. 2B is a perspective view of the fastener 10 as seen from below.

The fastener 10 is used to mount a member to be mounted on a mount member. For example, the fastener 10 is used to mount a hose or a wiring harness on a vehicle body panel or an interior panel. Namely, the hose or the wiring harness constitutes the member to be mounted, and the vehicle body panel or the interior panel constitutes the mount member. The fastener 10 is mounted on a bolt which is provided on the vehicle body panel so as to be erected therefrom.

The fastener 10 includes a mounting portion 20, a band fastening portion 22 and a band 24 and is formed from a resin material. The mounting portion 20 can be mounted on a bolt which is provided on the mount member. The band 24 fastens a member to be mounted. The band fastening portion 22 locks the band 24 which fastens the mount to be mounted. The bolt of the mount member is inserted into the mounting portion 20 with the band 24 fastening the member to be mounted to hold it, whereby the member to be mounted is fastened to the mount member.

The mounting portion 20 has a plurality of elastic claws 26, a cylindrical portion 28, a plurality of inner projecting portions 30, a suspended portion 32, a tapered portion 34, a plurality of inner flange portions 36, and a seating surface 38. The plurality of elastic claws 26 are formed so as to protrude from an inner circumferential surface towards a center axis of the cylindrical portion 28 and are disposed at equal intervals in a circumferential direction. The elastic claws 26 can be deflected and is locked in a root of a thread formed on the bolt which is inserted into the cylindrical portion 28.

The plurality of inner projecting portions 30 are formed so as to protrude from the inner circumferential surface towards the center axis of the cylindrical portion 28 and are disposed so as to be equally spaced apart from each other in the circumferential direction. The plurality of elastic claws 26 and the plurality of inner projecting portions 30 are disposed alternately on the inner circumferential surface of the cylindrical portion 28. The inner projecting portions 30 extend in an axial direction on the inner circumferential surface of the cylindrical portion 28 from an end where the seating surface 38 is formed to the suspended portion 32. The inner projecting portions 30 are brought into abutment with the bolt inserted into the cylindrical portion 28 so as to suppress the rattling looseness of the fastener 10.

The suspended portion 32 is formed into a beam on a deeper side of an inserting opening 35 of the cylindrical portion 28. The suspended portion 32 is suspended from an inner circumferential edge on an upper end side of the cylindrical portion 28 and passes through a center of the cylindrical portion 28. The suspended portion 32 continues to respective upper ends of the inner projecting portions 30. The suspended portion 32 prevents the bolt inserted into the cylindrical portion 28 from protruding out of the cylindrical portion 28 and functions to enhance the strength of the cylindrical portion 28.

The tapered portion 34 is formed around an edge of the inserting opening 35 of the cylindrical portion 28 so as to be inclined radially inwards therefrom and protrudes radially inwards towards a deeper or inner side of the cylindrical portion 28. The tapered portion 34 is formed around a full circumference of the edge of the inserting opening 35 of the cylindrical portion 28 to function as a guide for the bolt when the bolt is inserted into the cylindrical portion 28. The seating surface 38 is formed as an end face of the cylindrical portion 28 which lies at an end where the inserting opening 35 is formed and is brought into abutment with or comes close to the panel when the fastener 10 is mounted on the bolt.

The inner flange portions 36 are formed on an inner edge of the cylindrical portion 28 which lies at the end where the inserting opening 35 is formed so as to project radially inwards therefrom and are connected to the elastic claws 26 and the inner projecting portions 30. The inner flange portions 36 enable the tapered portion 34 to be formed along the full circumference of the inserting opening 35 to enhance the rigidity of the cylindrical portion 28 at the end where the seating surface 38 is formed while improving its guiding performance The suspended portion 32 and the inner flange portions 36 can help not only to enhance the rigidity of the cylindrical portion 28 at both the ends thereof but also to improve the durability of the mounting portion 20. The durability of the mounting portion 20 can be ensured even though the cylindrical portion 28 is formed thin by connecting the suspended portion 32 and the inner flange portions 36 together by the inner projecting portions 30.

The band 24 is formed into a belt-like flat thin strip and is wound around the member to be mounted to hold it. The band 24 has a multiplicity of engaging claws 60 which are formed in a longitudinal direction thereof. Additionally, the band 24 has side ribs 62 and oblique ribs 64 on an opposite side to a side where the engaging claws 60 are formed, that is, a side where a fastening surface 66 is provided which is brought into contact with the member to be mounted.

The side ribs 62 are formed individually on longitudinal edges of the fastening surface 66 of the band 24. The oblique ribs 64 are formed on the fastening surface 66 of the band 24 so as to lie between the side ribs 62. The oblique ribs 64 are inclined relative to a longitudinal direction and a widthwise direction of the band 24 and intersect each other. The side ribs 62 and the oblique ribs 64 are brought into abutment with the member to be mounted to restrict the movement of the member to be mounted. The side ribs 62 restricts the member to be mounted from moving in the longitudinal direction, and the oblique ribs 64 restricts the member to be mounted from being twisted.

As shown in FIG. 1B, the band fastening portion 22 is provided so as to continue to an outer circumferential surface of the mounting portion 20 and is formed in an angularly cylindrical shape having a rectangular cross section. The band fastening portion 22 supports the band 24 and locks the band 24 which is inserted thereinto. The band fastening portion 22 has a passage hole 40, a locking claw 42, a supporting wall portion 44, side wall portions 46, an inlet opening 48, an outlet opening 50, band guiding portions 52 and projecting portions 54.

The passage hole 40 is formed parallel to a bolt insertion hole which is defined by the cylindrical portion 28 of the mounting portion 20. The passage hole 40 is defined by the pair of side wall portions 46 and the supporting wall portion 44 which connects the side wall portions 46 together. The passage hole 40 has the inlet opening 48 shown in FIG. 2A from which the band 24 is let in and the outlet opening 50 shown in FIG. 2B from which the band 24 is let out. The supporting wall portion 44 is positioned at a front of the fastener 10 and supports the band 24, surrounding the member to be mounted together with the band 24. The supporting wall portion 44 extends in a direction from the inlet opening 48 towards the outlet opening 50, that is, along an axial direction of the passage hole 40 and has an upper end face which lies at an end or on a side thereof which faces the inlet opening 48 and a lower end face which lies at an end or on a side which faces the outlet opening 50. As shown in FIG. 2B, the pair of side wall portions 46 are positioned on both sides of the passage hole 40 in a widthwise direction thereof and are spaced apart from the band 24 in the widthwise direction.

The locking claw 42 is formed so as to be deflected radially inwards of the passage hole 40 and locks on the engaging claw 60 of the band 24 to function as a means for preventing the dislocation of the band 24 from the band fastening portion 22. As shown in FIGS. 1A and 2B, the band guiding portions 52 are formed on inner surfaces of the side wall portions 46 so as to project therefrom and guide the band 24 inserted into the band fastening portion 22 while restricting the movement thereof. The projecting portions 54 of the side wall portions 46 are each formed so as to project further forwards than an outer wall surface of the supporting wall portion 44 and are brought into abutment with the supported member to be mounted so as to suppress the rattling looseness of the member to be mounted.

Figure 3:
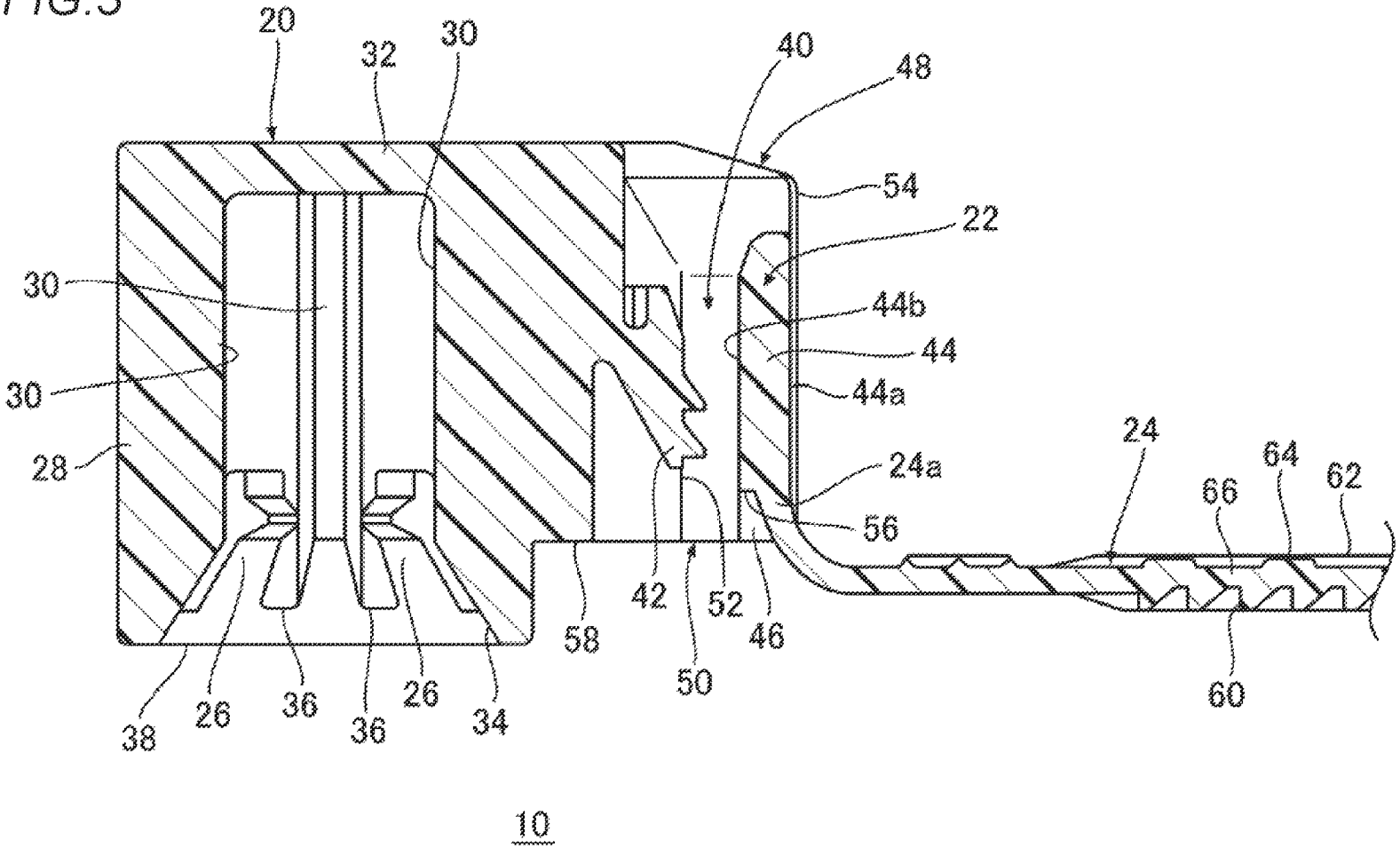
FIG. 3 is a sectional view of the fastener taken along a line A-A in FIG. 1A.
Figure 4:
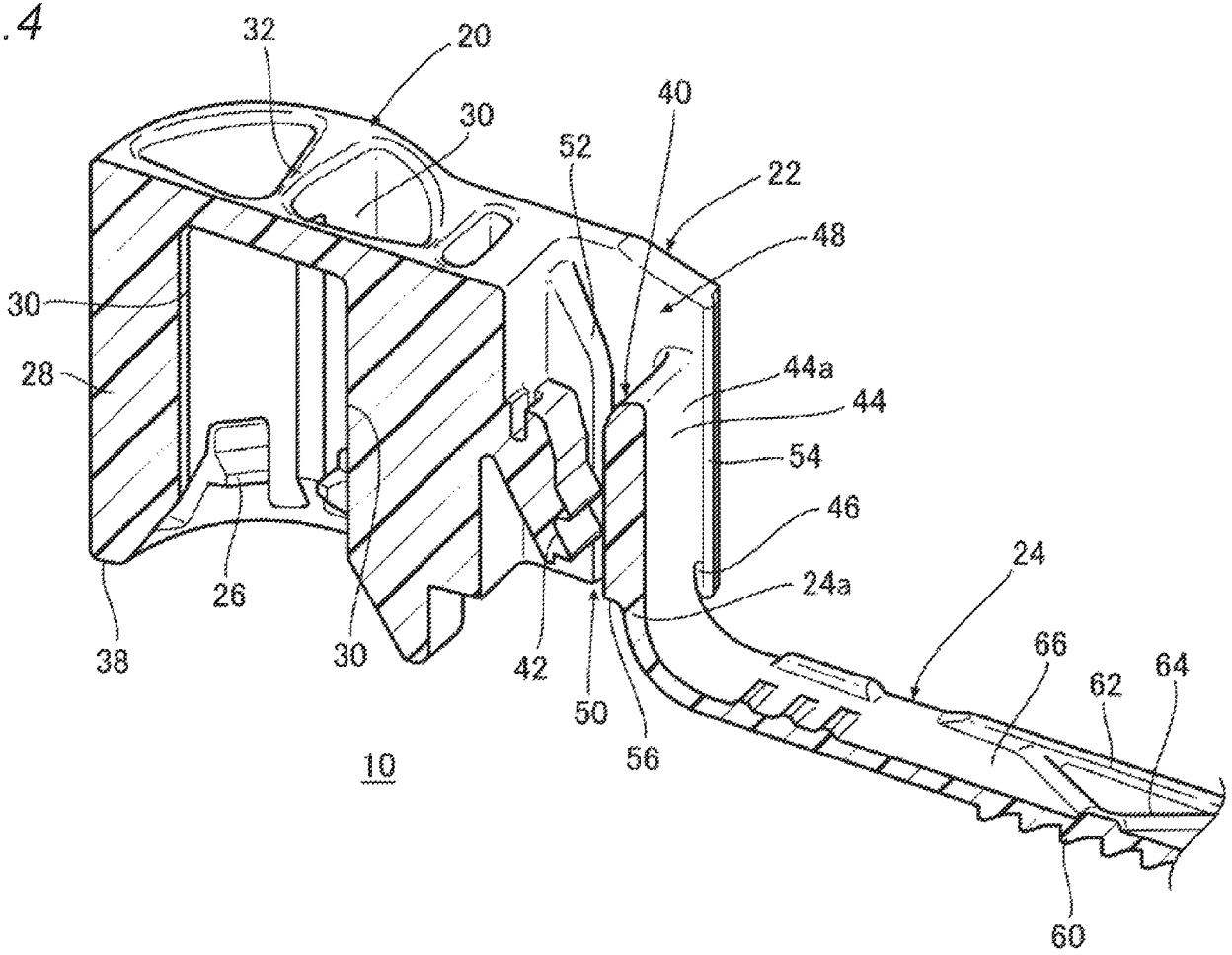
FIG. 4 is a perspective view of the fastener in section taken along the line A-A in FIG. 1A.
Figure 5:
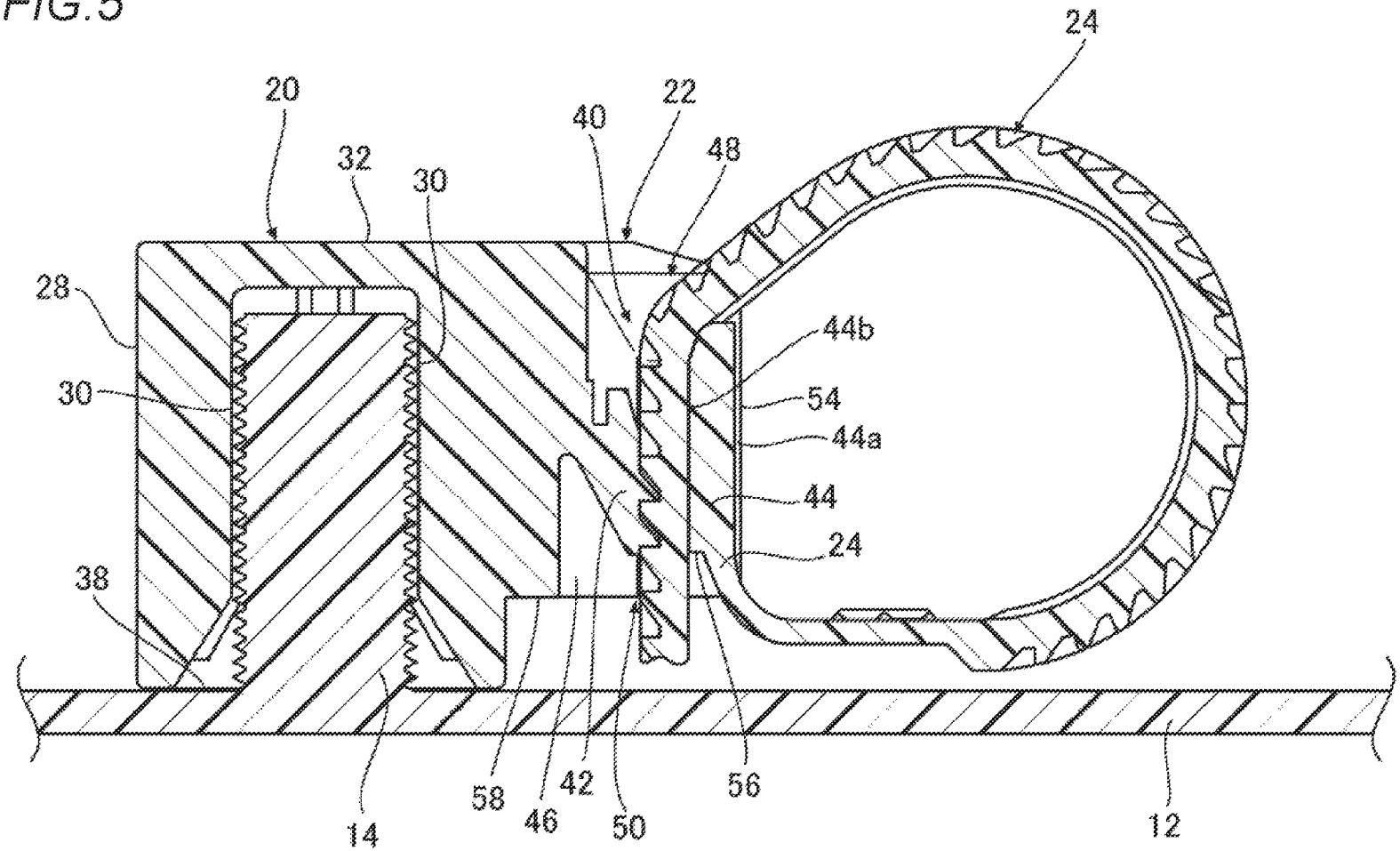
FIG. 5 is a sectional view showing a state in which the fastener is mounted on a bolt of a mount member.

FIG. 3 is a sectional view of the fastener 10 taken long a line A-A in FIG. 1A. FIG. 4 is a perspective view of the fastener 10 in section taken along the line A-A in FIG. 1A. FIG. 5 is a sectional view of the fastener 10 which is mounted on a bolt 14 of a mount member 12. In FIG. 5, the band 24 is wound into a loop and is locked by the locking claw 42 in the band fastening portion 22.

As shown in FIG. 3, a lower end face 58 of the band fastening portion 22 which lies on the side which faces the outlet opening 50 is positioned further upwards than the seating surface 38 of the mounting portion 20 and is set back further upwards than the seating surface 38. This configuration is adopted to prevent a cut end of the band 24 which results from cutting a portion of the band 24 which projects from the outlet opening 50 as shown in FIG. 5 from projecting further downwards than the seating surface 38 to be brought into abutment with the vehicle body panel so as to stabilize the posture of the fastener 10 after it has been mounted on the vehicle body panel.

Incidentally, in mounting, for example, a wiring harness on the bolt of the vehicle body panel by the use of the fastener 10, in case the wiring harness is supported by the band 24 in such a way as not to be greatly spaced apart from the vehicle body panel, the mounted state of the wiring harness is stabilized. Because of this, a proximal end portion 24*a* (a rood) of the band 24 is preferably positioned downwards so as to be closer to the side where the seating surface 38 is provided. Then, the band 24 is made to extend downwards from an end face 56 of the supporting wall portion 44 which lies on the side which faces the outlet opening 50, that is, a lower end portion of the supporting wall portion 44, and the proximal end portion 24*a* of the band 24 is disposed therebelow.

On the other hand, in the event that the proximal end portion 24*a* of the band 24 is made to extend downwards from the end face 56 of the supporting wall portion 44 which lies on the side which faces the outlet opening 50, in cutting the portion of the band 24 which projects from the outlet opening 50 with a tool such as a pair of scissors, there is a possibility that the proximal end portion 24*a* of the band 24 interferes with the pair of scissors. Then, in such a state that the pair of side wall portions 46 are provided so as to project along an inserting direction of the band 24 through the passage hole 40 with gaps provided between both sides of the proximal end portion 24*a* of the band 24 in the widthwise direction and the side wall portions 46 so formed, in case blades of the pair of scissors are pushed against the lower end face 58 of the band fastening portion 22 at the side walls 46 or lower end faces 58 of the side walls 46 from below, the proximal end portion 24*a* of the band 24 is pushed by the blades of the pair of scissors so as to be protected by the deflected side wall portions 46, whereby it becomes difficult for the proximal end portion 24*a* of the band 24 to be cut. In the event that the proximal end portion 24*a* of the band 24 is made to extend from a position which coincides in level or height with the lower end faces 58 of the side walls 46, the proximal end portion 24*a* of the band 24 is not protected by the side walls 46, increasing a risk of the proximal end portion 24*a* of the band 24 being cut by the pair of scissors.

The end face 56 of the supporting wall portion 44 which lies on the side which faces the outlet opening 50 is positioned upper than the lower end faces 58 of the side walls 46. Namely, the lower end faces 58 of the pair of side wall portions 46 which lie on the sides which faces the outlet opening 50 project further along the inserting direction of the band 24 through the passage hole 40 than the end face 56 of the supporting wall portion 44 which lies on the side which faces the outlet opening 50, whereby the proximal end portion 24*a* of the band 24 is held by the pair of side wall portions 46 with the gaps defined therebetween so as to be protected by the side walls 46. When the fastener 10 is seen from the side thereof as shown in FIG. 1B, the proximal end portion 24*a* of the band 24 overlaps the side wall portions 46 and is covered by the side wall portions 46. The side view of the fastener 10 results when it is seen from the side thereof, and lateral longitudinal sides of the fastener 10 extend along the widthwise direction of the band 24 and the supporting wall portion 44 and a direction in which the pair of side wall portions 46 face each other or a direction which is at right angles to surfaces of the side wall portions 46. A vertical length of the supporting wall portion 44 can be ensured by disposing the proximal end portion 24*a* of the band 24 in the lower position to thereby support the member to be mounted in a stable fashion.

As shown in FIG. 3, the supporting wall portion 44 has an outer wall surface 44*a* which faces the member to be mounted which is fastened by the band 24 and an inner wall surface 44*b* which lies on a side which faces the passage hole 40. The fastening surface 66 of the band 24 continues to the outer wall surface 44*a* and is formed level with the outer wall surface 44*a*. The band 24 extends from a position which is deflected closer to the outer wall surface 44*a* than to the inner wall surface 44*b*. Namely, a difference in level or a step is provided between the proximal end portion 24*a* of the band 24 and the inner wall surface 44*b* by the end face 56 of the supporting wall portion 44 which lies on the side which faces the outlet opening 50, whereby the proximal end portion 24*a* is positioned apart from the inner wall surface 44*b*. By adopting this configuration, the proximal end portion 24*a* of the band 24 is disposed farther away from the outlet opening 50, and in cutting a distal end of the band 24 which projects from the outlet opening 50, it becomes difficult for the proximal end portion 24*a* to be brought into interference with the pair of scissors. As shown in FIG. 4, the projecting portions 54 which are provided on both the sides of the proximal end portion 24*a* of the band 24 also function as guards for the proximal end portion 24*a* of the band 24 when the band 24 is cut.

As shown in FIG. 4, the inner projecting portions 30 are provided on a back side of the locking claw 42, whereby the rigidity of a proximal end portion of the locking claw 42 can be enhanced so as to suppress the rattling looseness of the locking claw 42. This makes it difficult for the locking claw 42 which locks on the band 24 to be dislocated from the band 24.

Figure 6B:
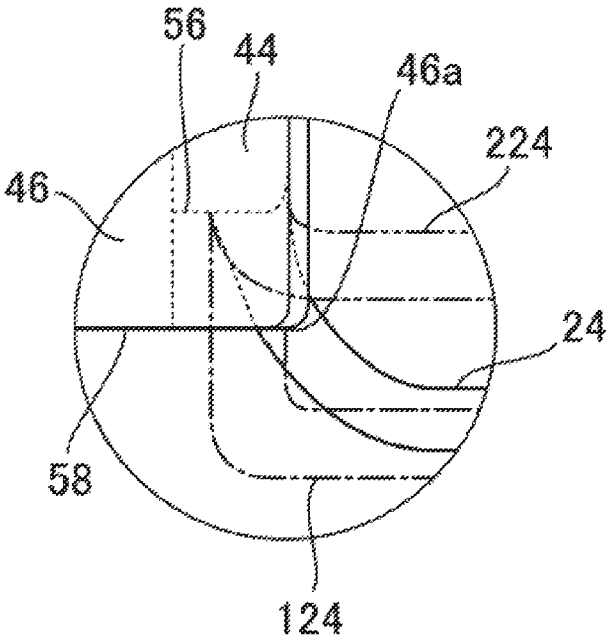
FIGS. 6A and 6B are views of bands according to the embodiment and modified examples.
Figure 6A:
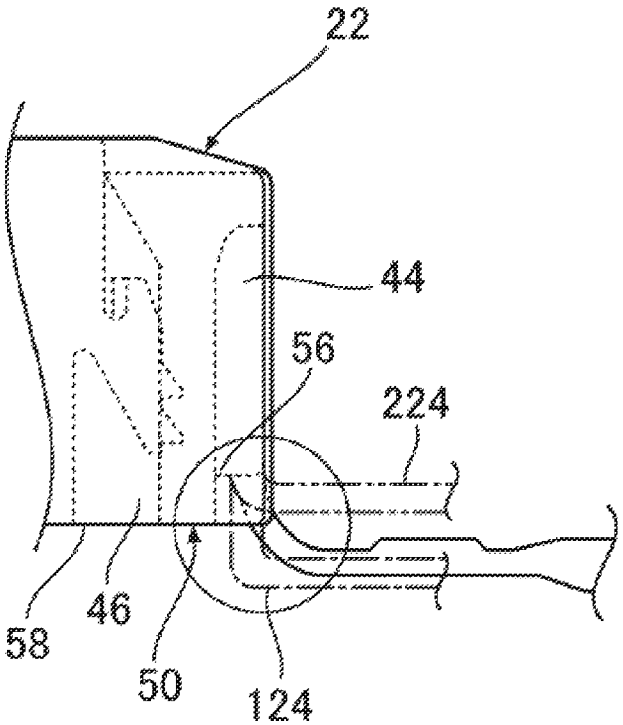

FIG. 6 shows views for describing the band of the embodiment and bands of modified examples. FIG. 6 shows a band 124 of a first modified example and a band 224 of a second modified example in addition to the band 24 of the embodiment. FIG. 6B shows an enlarged view of proximal ends of the bands shown in FIG. 6A.

The bands 24, 124, 224 all extend downwards from the end face 56 of the supporting wall portion 44 which lies on the side which faces the outlet opening 50, and proximal end portions thereof are disposed so as to be held between the pair of side wall portions 46 by the pair of side wall portions 46. By adopting this configuration, when cutting the bands 24, 124, 224, the proximal end portions of the bands 24, 124, 224 can be protected by the side walls 46 while disposing the proximal end portions of the bands 24, 124, 224 in lower positions.

The proximal end portions of the band 24 and the band 124 extend so as to overlap the lower end faces 58 of the side wall portions 46 when seen from the side. This enables the bands 24, 124 to extend downwards so as to come closer to a surface of the mount member 12, whereby the member to be mounted can be supported so as not to be spaced greatly apart from the mount member 12. The band 224 does not overlap the end faces 58 of the side wall portions 46 when seen from the side.

When seen from the side, the proximal end portion of the band 24 extends so as to overlap corner portions 46*a* of the side wall portions 46 which lie on the side which faces the outlet opening 50. By adopting this configuration, positioning the proximal end portion of the band 24 in a lower position and making it difficult for the proximal end portion of the band 24 to interfere with the pair of scissors when cutting the band 24 are allowed to function in a well balanced fashion. The corner portions 46*a* of the side wall portions 46 are positioned closer to the outer wall surface 44*a* of the supporting wall portion 44 at lower ends of the side wall portions 46.

The invention is not limited to the embodiment and the modified examples described above, and hence, various modifications can be made to the embodiment and the modified examples. The resulting embodiments can be included in the scope of the invention.

In the embodiment, the form is described in which the fastener 10 is mounted on the bolt of the mount member. However, the invention is not limited thereto, and hence, the fastener 10 may be mounted in a mount hole on the vehicle body panel. As this occurs, the fastener 10 has a plurality of elastic locking portions which lock on an edge of the mount hole as the mounting portion, and the plurality of elastic locking portions are deflected radially inwards when they are inserted into the mount hole and then expand radially outwards after they have been inserted into the mount hole to lock on the edge of the mount hole.

What is claimed is:

1. A fastener for mounting a member to be mounted on a mount member, comprising:

a band for fastening a member to be mounted;

a band fastening portion for locking the band which is tightened to fasten the member to be mounted; and a mounting portion for mounting the band fastening portion on a mount member, wherein the band fastening portion has:

a passage hole having an inlet opening and an outlet opening for the band;

a locking claw which locks on the band which is passed through the passage hole;

a supporting wall portion which surrounds the member to be mounted together with the band which is passed through the passage hole; and a pair of side wall portions which are positioned individually on both sides of the passage hole while connecting to both sides of the supporting wall portion, wherein the supporting wall portion extends in a direction from the inlet opening towards the outlet opening and has end faces which lie individually on a side thereof which faces the inlet opening and a side thereof which faces the outlet opening, wherein the band has a proximal end portion which extends from the end face of the supporting wall portion which lies on the side thereof which faces the outlet opening, wherein the pair of side wall portions are disposed so as to define a gap in a widthwise direction between the proximal end portion of the band and themselves, wherein end faces of the pair of side wall portions which lie on sides thereof which face the outlet opening project further in a passing direction of the band through the passage hole than the end face of the supporting wall portion which lies on the side thereof which faces the outlet opening, and wherein the proximal end portion of the band is hidden behind one of the pair of side wall portions when seen in a direction perpendicular to the passing direction of the band.

2. The fastener according to claim 1, wherein the band extends so that the end faces of the side wall portions which lie on the sides thereof which face the outlet opening overlap the band when the fastener is seen from a side thereof.

3. The fastener according to claim 1, wherein the band extends so that corner portions of the side wall portions which lie on the sides thereof which face the outlet opening overlap the band when the fastener is seen from a side thereof.

4. The fastener according to claim 3, wherein the supporting wall portion has an inner wall surface which is positioned on a side thereof which faces the passage hole and an outer wall surface which is positioned on a side thereof which faces the member to be mounted which is fastened, and wherein the band extends from a position which deflects closer to the outer wall surface than to the inner wall surface on the end face of the supporting wall portion which lies on the side thereof which faces the outlet opening.

5. The fastener according to claim 4, wherein a fastening surface of the band which lies on a side thereof which is brought into contact with the mount member is formed so as to be level with the outer wall surface, and wherein the pair of side wall portions have projecting portions which protrude from the outer wall surface.

6. The fastener according to claim 1, wherein the mounting portion includes:

a plurality of elastic claws;

a cylindrical portion; and a plurality of inner projecting portions;

wherein the plurality of elastic claws are formed so as to protrude from an inner circumferential surface towards a center axis of the cylindrical portion and are disposed at equal intervals in a circumferential direction, wherein the plurality of inner projecting portions are formed so as to protrude from the inner circumferential surface towards the center axis of the cylindrical portion and are disposed so as to be equally spaced apart from each other in the circumferential direction, and wherein the plurality of elastic claws and the plurality of inner projecting portions are disposed alternately on the inner circumferential surface of the cylindrical portion.

7. The fastener according to claim 6, wherein the passage hole of the band fastening portion is formed parallel to the cylindrical portion of the mounting portion.

8. The fastener according to claim 6, wherein the passing direction and a mounting direction for mounting the band fastening portion on the mount member are parallel, and wherein the mounting direction and the center axis of the cylindrical portion are collinear.

9. The fastener according to claim 1, wherein the mounting portion includes:

a plurality of elastic claws;

a cylindrical portion;

a plurality of inner projecting portions;

a suspended portion;

a tapered portion;

a plurality of inner flange portions; and a seating surface, wherein the plurality of elastic claws are formed so as to protrude from an inner circumferential surface towards a center axis of the cylindrical portion and are disposed at equal intervals in a circumferential direction, wherein the plurality of inner projecting portions are formed so as to protrude from the inner circumferential surface towards the center axis of the cylindrical portion and are disposed so as to be equally spaced apart from each other in the circumferential direction, wherein the plurality of elastic claws and the plurality of inner projecting portions are disposed alternately on the inner circumferential surface of the cylindrical portion, and wherein the inner projecting portions extend in an axial direction on the inner circumferential surface of the cylindrical portion from an end where the seating surface is formed to the suspended portion.

10. The fastener according to claim 1, wherein the mounting portion includes:

a plurality of elastic claws;

a cylindrical portion;

a plurality of inner projecting portions;

a suspended portion;

a tapered portion; and a seating surface, wherein the plurality of elastic claws are formed so as to protrude from an inner circumferential surface towards a center axis of the cylindrical portion and are disposed at equal intervals in a circumferential direction, wherein the plurality of inner projecting portions are formed so as to protrude from the inner circumferential surface towards the center axis of the cylindrical portion and are disposed so as to be equally spaced apart from each other in the circumferential direction, wherein the suspended portion is formed into a beam on a deeper side of an inserting opening of the cylindrical portion, and wherein the suspended portion is suspended from an inner circumferential edge on an upper end side of the cylindrical portion, passes through a center of the cylindrical portion and the suspended portion continues to respective upper ends of the inner projecting portions.

11. The fastener according to claim 10, wherein the tapered portion is formed around an edge of the inserting opening of the cylindrical portion so as to be inclined radially inwards therefrom and protrudes radially inwards towards a deeper or inner side of the cylindrical portion, wherein the tapered portion is formed around a full circumference of the edge of the inserting opening of the cylindrical portion to function as a guide for the mount member when the mount member is inserted into the cylindrical portion, and wherein the seating surface is formed as end face of the cylindrical portion which lies at an end where the inserting opening is formed and is brought into abutment with or comes close to a panel when the fastener is mounted on a bolt.

12. The fastener according to claim 11, wherein inner flange portions are formed on an inner edge of the cylindrical portion which lies at the end where the inserting opening is formed so as to project radially inwards therefrom and are connected to the elastic claws and the inner projecting portions.

13. The fastener according to claim 1, wherein the band is formed into a belt-like flat thin strip and is wound around the member to be mounted to hold the member.

14. The fastener according to claim 1, wherein the band includes:

a plurality of engaging claws which are formed in a longitudinal direction thereof;

side ribs formed on a side where a fastening surface is provided which is brought into contact with the member to be mounted; and oblique ribs formed on the side where the fastening surface is provided which is brought into contact with the member to be mounted.

15. The fastener according to claim 14, wherein the side ribs are formed individually on longitudinal edges of the fastening surface of the band, wherein the oblique ribs are formed on the fastening surface of the band so as to lie between the side ribs, wherein the oblique ribs are inclined relative to a longitudinal direction and a widthwise direction of the band and intersect each other.

16. The fastener according to claim 14, wherein the side ribs and the oblique ribs are brought into abutment with the member to be mounted to restrict the movement of the member to be mounted.

17. The fastener according to claim 15, wherein the side ribs restrict the member to be mounted from moving in the longitudinal direction, and wherein the oblique ribs restrict the member to be mounted from being twisted.

18. The fastener according to claim 1, wherein the passing direction and a mounting direction for mounting the band fastening portion on the mount member are parallel.

19. The fastener according to claim 18, wherein the mounting portion includes a cylindrical portion having a center axis that is collinear to the mounting direction.

20. The fastener according to claim 1, wherein a lower end face of the band fastening portion which lies on the side which faces the outlet opening is positioned further upwards in the passing direction than a bottom surface of the mounting portion.

* * * * *